United States Patent [19]

Ripka

[11] Patent Number: 4,945,890

[45] Date of Patent: Aug. 7, 1990

[54] INDUCED DRAFT WARM AIR FURNACE WITH RADIANT INFRARED BURNER

[75] Inventor: Chester D. Ripka, East Syracuse, N.Y.

[73] Assignee: Carrier Corporation, Syracuse, N.Y.

[21] Appl. No.: 402,734

[22] Filed: Sep. 5, 1989

[51] Int. Cl.[5] ..... F24H 3/02

[52] U.S. Cl. ..... 126/110 R; 126/116 A; 126/391

[58] Field of Search ..... 126/110 R, 391, 116 A

[56] References Cited

U.S. PATENT DOCUMENTS

| | | | |
|---|---|---|---|
| 2,182,735 | 12/1939 | O'Dowd | 126/391 |
| 2,452,472 | 10/1948 | Keating | 126/391 |
| 4,314,542 | 2/1982 | Bratko | 126/110 R |
| 4,688,547 | 8/1987 | Ballard et al. | 126/116 A |

OTHER PUBLICATIONS

Advertising brochure "Thermo Pride Radiant Gas Furnace," author unknown, ThermoPride Form AG5-75-6810, 6 Pages, publication date unknown, published by Thermoproducts, Inc., North Judson, Indiana.

*Primary Examiner*—Larry Jones
*Attorney, Agent, or Firm*—Charles E. Adams

[57] ABSTRACT

An induced draft warm air furnace employing a radiant infrared burner. The use of a radiant burner results in a very low concentration of oxides of nitrogen ($NO_X$), in the combustion gases produced. In addition, the use of a radiant burner eliminates the combustion roar produced by other types of burners found in similar furnaces. Further, the invention allows the attainment of the advantages of a radiant burner in a furnace of otherwise standard design with only minor modification. The scope of the invention includes the use of the radiant burner within a combustion chamber which is either within the heat exchanger enclosure and joined to the heat exchanger or within a burner box mounted external to the heat exchanger enclosure but having means for the free passage of combustion gases from the combustion chamber to the heat exchanger. The use of induced draft eliminates the possibility of combustion gases leaking out of the combustion chamber or heat exchanger.

16 Claims, 3 Drawing Sheets

32
34
35
43
45
47
44
51
27
27
48
48
48
-22-

INDUCED DRAFT WARM AIR FURNACE WITH RADIANT INFRARED BURNER

BACKGROUND OF THE INVENTION

1. Field of the Invention

This invention relates to the use of radiant infrared burners in warm air furnaces. In particular, the invention relates to the use of such burners in a furnace having a pressure in its combustion chamber and heat exchanger that is lower than the air surrounding the furnace, with such a reduced pressure being created by an induction blower.

2. Description of the Prior Art

Warm air furnaces are used in residential and commercial applications for such purposes as heating spaces within a building. In such a furnace, air is drawn into the furnace where it is heated by contact with a heat exchanger. The air then passes to the space to be heated. The heat exchanger in turn is heated by burning fuel and the gases produced by the burning fuel. It is normal practice to produce furnaces with more than one heat exchanger, the number of heat exchangers in a given furnace being determined by heat exchanger design and by desired furnace heat output capacity.

The usual means by which a gaseous or vaporized liquid fuel is burned in a furnace is a ribbon type burner located under the heat exchanger or by what is known in the industry as an "inshot" or jet type burner whose flame is directed into the inlet of the heat exchanger. Natural convection or a blower to create a forced draft are generally used to cause the gases of combustion to flow through and out of the heat exchanger. In such a furnace, the burning process generates not only heat but low frequency sound termed "combustion roar." If the furnace is connected to a hot air ducting system, the ducting tends to amplify the sound and transmit it to spaces remote from the furnace.

The products of combustion from flame burners in the furnaces now in widespread use contain oxides of nitrogen ($NO_x$). These oxides are vented to the atmosphere with the combustion products as flue gases. Limiting the concentration of $NO_x$ in the flue gases is desirable, as furnaces sold in certain jurisdictions must comply with very low $NO_x$ emission requirements.

The use of a radiant infrared burner in a furnace instead of the more usual flame burner has certain advantages, chief among them as pertain to this invention are that the gases of combustion produced by a radiant burner have very low concentrations of $NO_x$ and that the radiant burner burns silently, without producing combustion roar.

When a radiant burner is in operation, a mixture of a gaseous fuel and air is supplied to the interior of the burner shell. The mixture then passes through a gas-permeable material in the wall or shell of the burner and burns on the outer surface of the burner's wall or shell. To cause the mixture to pass through the gas-permeable material, the pressure within the burner must be greater than the pressure on the burner's exterior. Generally, this pressure differential is achieved by raising the internal pressure, e.g. by using a means to supply the gas/air to the burner interior at an elevated pressure (with respect to the air surrounding the furnace). With an elevated internal burner pressure, in order for the hot gases of combustion to flow from the burner to the flue, the entire gas flow path, including the heat exchanger, must be at a pressure greater than the surrounding air. If this is the case, and if there is a means for free communication of gases between the gas side and circulating air side of the heat exchanger, e.g. a hole due to damage to or deterioration of the heat exchanger shell, then combustion gas could leak from the gas side into the circulating air side of the furnace and be carried with the air to the heated spaces.

Designers in the industry have developed warm air furnaces in which a radiant burner is used, see e.g. Bratko, U.S. Pat. No. 4,314,542.

SUMMARY OF THE INVENTION

An object of this invention is to employ a radiant infrared burner in a warm air furnace used for residential and commercial heating purposes in order to take advantage of the radiant burner's attributes of silent operation and low concentration of $NO_x$ in its gases of combustion.

Another object of the invention is to attain the required differential pressure across the gas-permeable material of the burner by lowering the pressure on the exterior of the burner and thus in the burner combustion chamber and heat exchanger. In this way, the possibility of leakage of combustion gases out of the heat exchanger is eliminated.

A further object of the invention is to obtain the advantages of the use of a radiant infrared burner in a furnace of otherwise standard design with no or only minor modifications or adjustments being needed to the configuration of the heat exchanger and other components of the furnace.

These and other objects of the invention are achieved in one embodiment of the invention by the provision of a combustion chamber section in a furnace heat exchanger into which is mounted a radiant infrared burner.

In another embodiment, the objects are achieved by locating the combustion chamber and radiant burner in a burner box mounted external to the heat exchanger enclosure of the furnace, with provision for free communication for the passage of gases of combustion from the combustion chamber to the heat exchanger. In this embodiment, there is an air passage formed between the walls and ends of the combustion chamber and the burner box surrounding it. Combustion air enters the burner box one at end and must travel the entire length of the air passage, undergoing an amount of preheating, before being mixed with the fuel supplied to the radiant burner. The combustion efficiency of the furnace is thus enhanced.

In both embodiments, a combustible gas comprising a mixture of fuel and air is supplied to the interior of the radiant burner via a fuel/air feed pipe. The combustion chamber in which the radiant burner is located is otherwise closed to the entry of air, hence no secondary combustion takes place within the combustion chamber.

In both embodiments, hot gases of combustion are drawn from the combustion chamber, through the heat exchanger and out of the furnace by an induced draft, so that the pressure within the combustion chamber and heat exchanger is maintained at a level lower than that of the air surrounding the heat exchanger while the furnace is in operation. In this way, should a hole be present or develop in the wall of the heat exchanger, leakage through the hole would be from the circulating air side to the combustion gas side of the heat exchanger, rather than vice versa, an improvement over prior art warm air furnaces using radiant burners.

Although preferred embodiments of the present invention are illustrated and described, other embodiments of the invention may occur to those skilled in the art. It is therefore intended that the invention be limited only by the scope of the appended claims.

BRIEF DESCRIPTION OF THE DRAWINGS

The accompanying drawings form a part of the specification. Throughout the various drawings, like reference numbers designate like or corresponding parts.

DESCRIPTION OF THE PREFERRED EMBODIMENTS

The embodiments of the invention described below are adapted for use in a compact residential or commercial warm air furnace. It is understood, however, that the invention defines like use in similar types of furnaces. It should be noted that the drawings and specifications envision the use in the furnace of a gaseous fuel such as natural gas or liquified petroleum gas. As one skilled in the art is aware, a radiant infrared burner will exhibit the same desired characteristics when burning a mix of air and a vaporized liquid fuel such as fuel oil or kerosene. It is intended therefore that the scope of the invention includes the use of a radiant burner in a warm air furnace as disclosed with any suitable type of a fuel supply, including means to vaporize liquid fuel before mixing it with air for combustion where necessary and appropriate. Moreover, the drawings and specifications envision a single radiant infrared burner mounted within each combustion chamber and more than one heat exchanger mounted in a furnace. It is to be understood that variations of that configuration are included within the scope of this invention.

Figure 1:
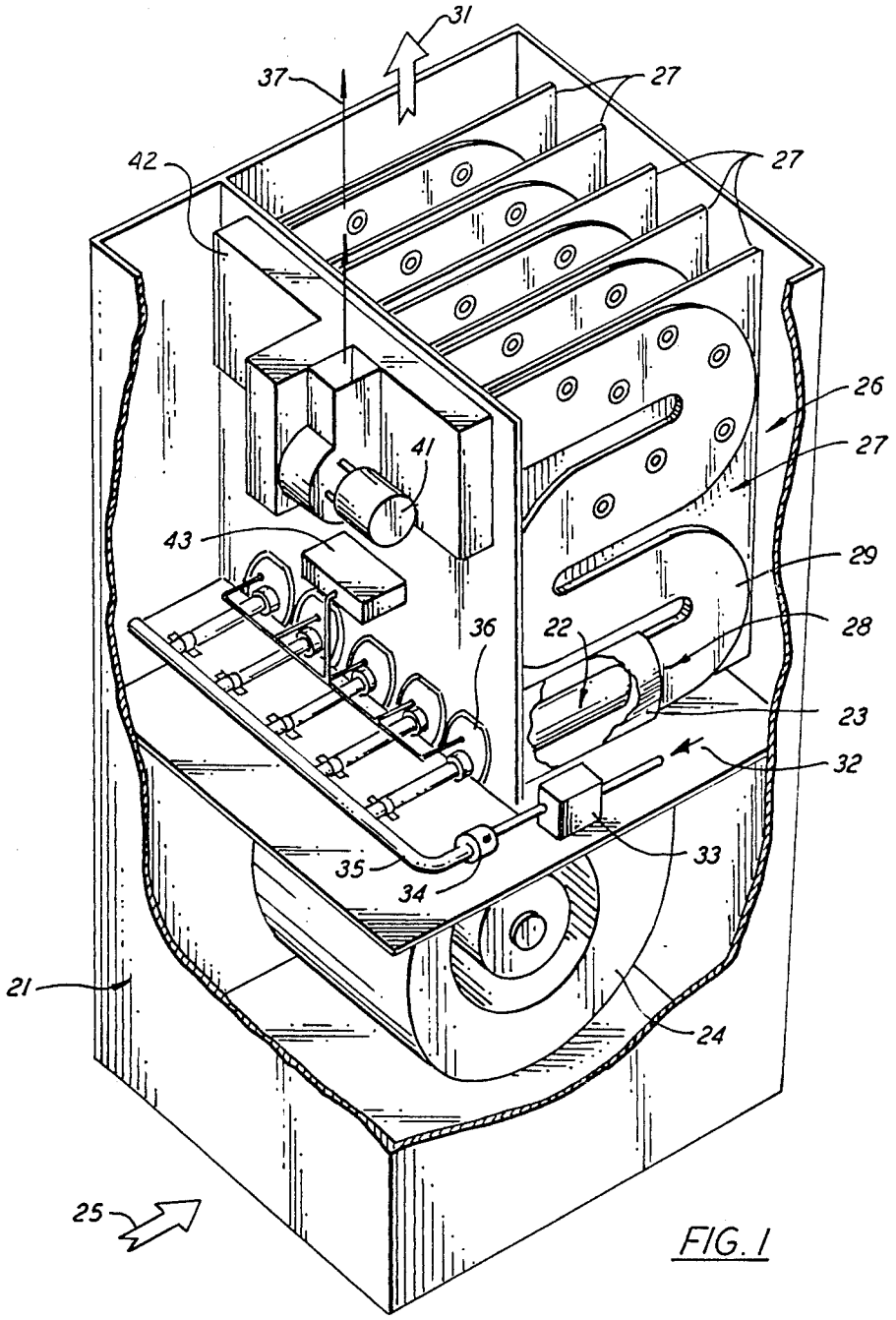
FIG. 1 is an isometric view, partly broken away, of one embodiment of the invention in which the combustion chamber is located within the heat exchanger enclosure and joined to the heat exchanger.

In one embodiment of the invention, the combustion chamber containing the radiant infrared burner is located within the heat exchanger enclosure. FIG. 1 is an isometric view, partly broken away, of a warm air furnace 21 incorporating this embodiment. Such a furnace contains a blower 24 which draws cool air 25 into the furnace 21 and forces the air through a heat exchanger enclosure 26 surrounding heat exchanger 27 where the air is heated by contact with the heat exchanger exterior walls 29. The heated air 31 then exits the furnace. The heat exchanger 27 is heated by gases of combustion produced by a radiant infrared burner 22 located in a combustion chamber 23. The combustion chamber 23 is joined to the heat exchanger 27 at union 28 or is an integral part of the heat exchanger. The combustion gases are drawn out of the combustion chamber 23, through the the heat exchanger 27 and header 42 by induction draft unit 41, which exhausts the gases to a discharge flue 37. The induction draft unit 41 only operates when the furnace operates (i.e. the burners lighted). The induction draft unit 41, when not operating, serves to prevent gases of combustion from exiting the furnace after shutdown, thus performing a similar function to that of a flue damper. The induction draft unit 41 serves to maintain the pressure within the combustion chamber 23, heat exchanger 27 and header 42 at a level below that of the surrounding air at all times the furnace is in operation. The furnace 21 has a fuel gas supply 32 controlled by a regulator 33. Air for combustion is drawn from ambient air within the furnace through an air inlet port 34 in a fuel/air feed pipe 35 where it mixes with the fuel gas to form a combustible gas. The draft created by the induction draft unit 41 in the combustion chamber 23, draws the combustible gas through the feed pipe 35 into the interior of the burner 22 and through gas-permeable walls of the burner to the outer surface of the burner, where the fuel burns. The outer end 36 of the combustion chamber 23 is otherwise closed to the passage of air so that the only air entering the chamber is that which is mixed with fuel at the inlet port 54, and hence there is no secondary combustion. Ignition device 43, which initially lights the mixture of gas and air on start-up of the furnace, is a conventional furnace control and is not described in detail. In such a conventional control, a spark ignition system ignites the air/fuel mixture and a flame detector senses whether combustion actually occurs. In this embodiment, the wall of the combustion chamber 23, which is radiantly as well as conductively heated by the burner 22, is in contact with and heats the air in the heat exchanger enclosure 26.

Figure 2:
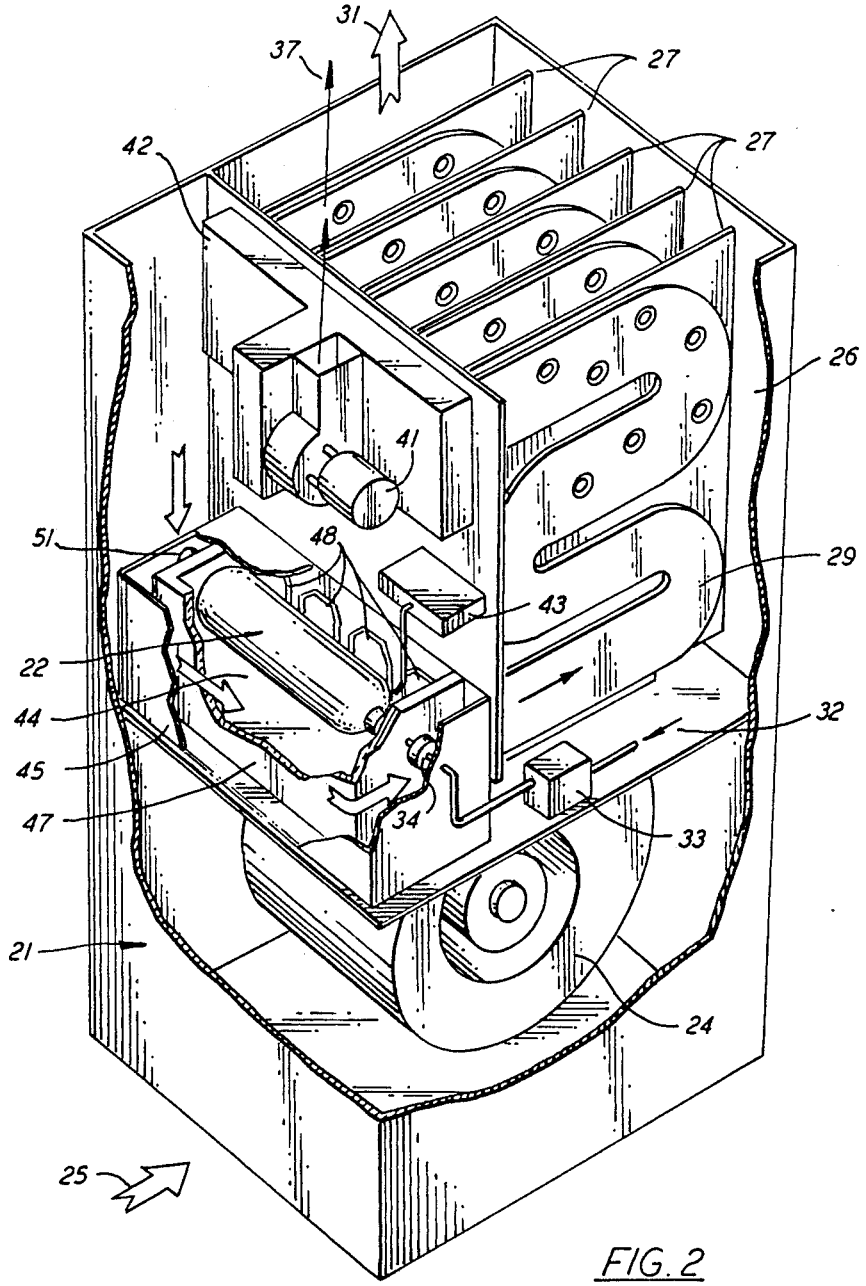
FIG. 2 is an isometric view, partly broken away, of another embodiment of the invention in which the combustion chamber is mounted in a burner box located external to the heat exchanger enclosure, but with a path for gases of combustion to pass from between the combustion chamber to the heat exchanger.
Figure 3:
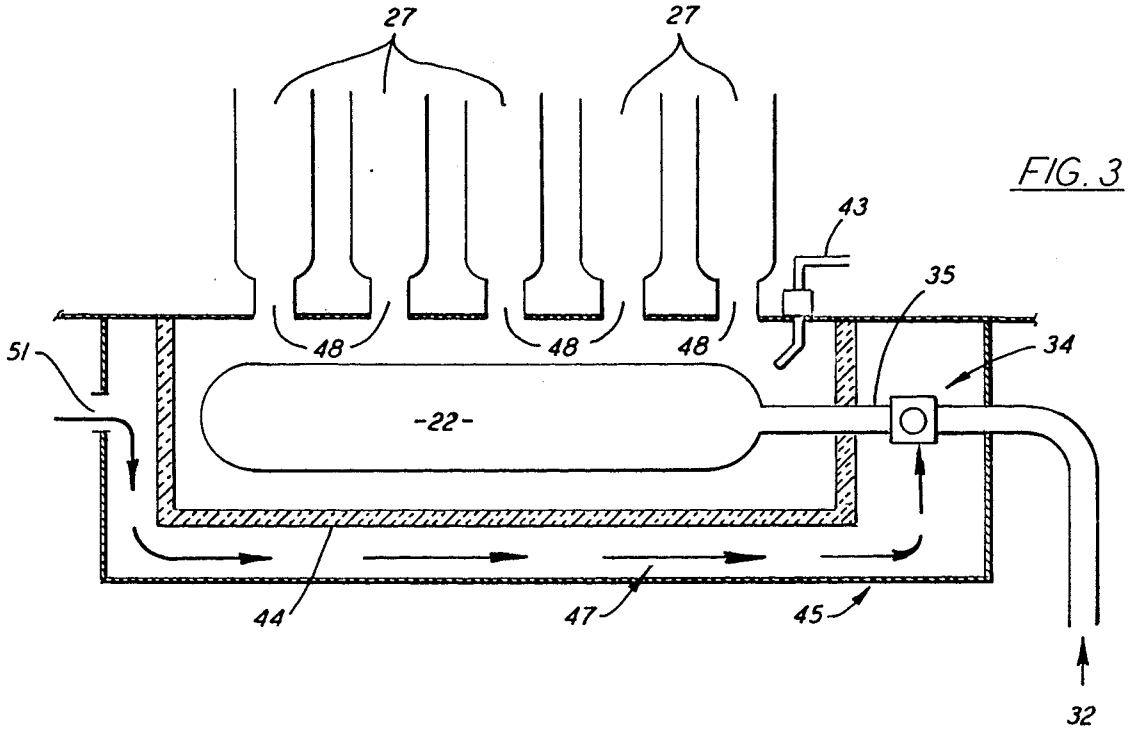
FIG. 3 is a plan view, in section, of a detail of the embodiment of the invention depicted in FIG. 2 showing the arrangement of the burner box, combustion chamber, air passage and the flow path for combustion air from the exterior of the burner box to the air inlet port.

In another embodiment of the invention, the combustion chamber is external to the heat exchanger enclosure but communicates with the inlet of the heat exchanger. FIG. 2 is an isometric view, partly broken away, of a warm air furnace 21 incorporating the embodiment and shows the external combustion chamber 44 containing the radiant infrared burner 22, all enclosed within a burner box 45. The flow of cool air through the blower 24, around the heat exchanger 27 located in the heat exchanger enclosure 26 and the flow of heated air 31 out of the furnace are similar to the embodiment shown in FIG. 1. In the same manner, construction and operation of the induction draft unit 41, header 42, discharge flue 37, fuel gas supply 32, regulator 33, ignition device 43, fuel/air feed pipe 35 and air inlet port 34 are all functionally the same as the embodiment of FIG. 1. In this embodiment, the external combustion chamber 44 has an insulated wall and ends. Surrounding the combustion chamber is a burner box 45, configured so that there is a space, forming an air passage 47, between the combustion chamber and the interior wall and ends of the burner box. Referring to FIG. 3, which shows details of the construction of the burner box 45 and combustion chamber 44, air for combustion enters the air passage 47 through a combustion air inlet 51 located in one end of the burner box. The combustion air undergoes an amount of preheating, for increased furnace efficiency, as it passes along the entire length of the combustion chamber before reaching the air inlet port 34, located in the air passage 47 at the opposite end of the burner box. The combustion air mixes with the fuel gas supply 32 at the air inlet port 34 to form a combustible gas that passes through the fuel/air feed pipe to the burner. As in the embodiment of FIG. 1, the combustion chamber 44 is otherwise closed to the passage of air so that the only air entering the chamber is that which is mixed with fuel, and hence there is no secondary combustion. Combustion gases produced by the burning fuel on the exterior of the burner pass from the combustion chamber 44 to the heat exchanger 27 via combustion gas passage 48.

What is claimed is:

1. A warm air furnace having a heat exchanger enclosure comprising:

an updraft heat exchanger within said heat exchanger enclosure;

means for circulating air to be heated through said heat exchanger enclosure and around said heat exchanger;

a combustion chamber having means for passing gases of combustion from said combustion chamber to said heat exchanger and a combustible gas inlet and otherwise sealed to the entry and exit of air or other gases;

a radiant infrared burner mounted within said combustion chamber and in closed flow communication with said combustible gas inlet;

means for mixing fuel and air drawn from within the space to be heated by said furnace to form a combustible gas for combustion on said burner;

a combustible gas feed pipe connecting said mixing means to said inlet; and means for both inducing (a) a flow of said combustible gas from said mixing means, through said feed pipe and said inlet to and through said burner and (b) a flow of gases of combustion from said combustion chamber through said heat exchanger.

2. A furnace as set forth in claim 1 in which said mixing means is the sole source of air for combustion for said burner.

3. A furnace as set forth in claim 2 in which said combustion chamber is external to said heat exchanger enclosure.

4. A furnace as set forth in claim 3 further including a burner box which encloses said combustion chamber.

5. A furnace as set forth in claim 4 in which said burner box has means for preheating air supplied for combustion before said combustion air is mixed with fuel by said mixing means.

6. A furnace as set forth in claim 5 in which said combustion chamber has a wall, a first end and a second end;

said burner box has a wall, a first end and a second end and a combustion air inlet means in said burner box first end; and said preheating means is an air passage formed between said burner box wall and ends and said combustion chamber wall and ends.

7. A furnace as set forth in claim 6 in which said combustion chamber wall and ends are insulated.

8. A furnace as set forth in claim 7 in which said combustion chamber and said burner box first ends are adjacent and said combustion chamber and said burner box second ends are adjacent;

said mixing means has a combustion air inlet port in said air passage between said respective second ends of said burner box and said combustion chamber; and air for combustion must pass through said air passage from said combustion air inlet means to said combustion air inlet port.

9. A combustion system employing a radiant infrared burner in a warm air furnace having a heat exchanger enclosure comprising:

an updraft heat exchanger within said heat exchanger enclosure;

a combustion chamber having means for passing gases of combustion from said combustion chamber to said heat exchanger, a combustible gas inlet and otherwise sealed to the entry and exit of air or other gases and within which combustion chamber is mounted a radiant infrared burner in closed flow communication with said combustible gas inlet;

means for mixing fuel and air drawn from within the space to be heated by said furnace to form a combustible gas for combustion on said burner;

a combustible gas feed pipe connecting said mixing means to said inlet; and means for both inducing (a) a flow of said combustible gas from said mixing means through said feed pipe and said inlet to and through said burner, and (b) a flow of gases of combustion from said combustion chamber through said heat exchanger.

10. A system as set forth in claim 9 in which said mixing means is the sole source of combustion air for said burner.

11. A system as set forth in claim 10 in which said combustion chamber is external to said heat exchanger enclosure.

12. A system as set forth in claim 11 further including a burner box which encloses said combustion chamber.

13. A system as set forth in claim 12 in which said burner box has means for preheating air for combustion before said combustion air is mixed with fuel by said mixing means.

14. A system as set forth in claim 13 in which said combustion chamber has a wall, a first end and a second end;

said burner box has a wall, a first end and a second end and a combustion air inlet means in said burner box first end; and said preheating means is an air passage formed between said burner box wall and ends and said combustion chamber wall and ends.

15. A system as set forth in claim 14 in which said combustion chamber wall and ends are insulated.

16. A system as set forth in claim 15 in which said combustion chamber and said burner box first ends are adjacent and said combustion chamber and said burner box second ends are adjacent;

said mixing means has a combustion air inlet port in said air passage between said respective second ends of said burner box and said combustion chamber; and air for combustion must pass through said air passage from said combustion air inlet means to said combustion air inlet port.

* * * * *